United States Patent [19]

Yamanaka

[11] 4,386,867

[45] Jun. 7, 1983

[54] MULTANGULAR PEN NIB CONSTRUCTION

[76] Inventor: Shizuo Yamanaka, 16-13-301, Shimorenjaku 4-chome, Mitaka-shi, Tokyo, Japan

[21] Appl. No.: 246,963

[22] Filed: Mar. 24, 1981

[30] Foreign Application Priority Data

Mar. 26, 1980 [JP] Japan ..... 55-37517

[51] Int. Cl.[3] ..... B43K 1/12; B43K 3/00

[52] U.S. Cl. ..... 401/292; 401/222; 401/241; 401/258

[58] Field of Search ..... 401/221–225, 401/292, 241, 261, 258

[56] References Cited

U.S. PATENT DOCUMENTS

| | | | |
|---|---|---|---|
| 82,598 | 9/1868 | Chinn | 401/258 |
| 1,649,676 | 11/1927 | Eversole | 401/292 |
| 1,836,342 | 12/1931 | Siptrott | 401/222 |
| 1,903,965 | 4/1933 | Frank | 401/268 |
| 2,033,164 | 3/1936 | Walter | 401/258 |
| 2,734,486 | 2/1956 | Aramian | 401/292 |
| 3,424,539 | 1/1969 | Jenkins | 401/292 |
| 3,614,248 | 10/1971 | Otsuka | 401/292 |

FOREIGN PATENT DOCUMENTS

| | | | |
|---|---|---|---|
| 2140435 | 2/1972 | Fed. Rep. of Germany | 401/292 |
| 433012 | 4/1948 | Italy | 401/292 |
| 440013 | 10/1948 | Italy | 401/292 |
| 480196 | 12/1969 | Switzerland | 401/261 |
| 90 of 1874 | | United Kingdom | 401/292 |
| 2050254 | 1/1981 | United Kingdom | 401/221 |

*Primary Examiner*—William Pieprz

*Attorney, Agent, or Firm*—Karl W. Flocks; Sheridan Neimark

[57] ABSTRACT

A pen nib construction comprising a pen nib and a holder in which the pen nib is fitted. The pen nib is constructed by a plurality of pen nib pieces fixed back-to-back to each other and forming an ink channel extending axially, and the pen nib is provided at its pointed end with long splits and relatively short recesses which are disposed alternately and at equal angular distances. The pen nib contains an ink-containing portion near its pointed end. One end of the holder is divided into a plurality of ink feed tongues which are in contact with the outer surface of the pen nib. The other end of the holder is connected to an ink reservoir of the pen. At least one of the pen nib pieces is provided on its intermediate portion with another split which connects the ink channel with outside of the pen nib. Thus, ink is supplied from the ink reservoir to the pointed end of the pen nib through a plurality of passages including the ink channel and the narrow gap between the pen nib and the ink feed tongues. The feeding of ink through the ink channel or the narrow gap is carried out by capillarity action taking place at their portion. From the pointed end of the pen nib, ink flows out through the splits and the recesses onto the paper.

4 Claims, 10 Drawing Figures

MULTANGULAR PEN NIB CONSTRUCTION

BACKGROUND OF THE INVENTION

1. Field of the Invention

The present invention relates to a multangular pen nib construction comprising a plurality of pen nib pieces fixed back-to-back to each other, and more particularly to such a multangular pen nib construction which is easy to manufacture and almost free from clogging when the pen is being used, and further more which is improved to prevent the ink from reverse flowing toward the ink reservoir of the pen when the pen is left with the pointed end of the pen nib pointing upward.

2. Description of the Prior Art

Fountain pens such as in usual use, which include a pen nib construction comprising a single-piece pen nib and its holder have the disadvantage that they can operate only in a certain direction. To obviate the disadvantage, a multangular pen nib construction has been provided, which comprises a plurality of (three for instance) pen nib pieces, similar to conventional pen nibs, that are fixed back-to-back to each other and held in the holder so as to make it possible to write in all directions.

An example of the prior multangular pen nib construction is shown in FIGS. 1 to 5. The multangular pen nib construction as shown in FIG. 2 has been made as follows. At first, three pen nib pieces 1, each having a slit or split 3 at a center of the pointed end and another slit or split 9 at its root, and notches 4 at both edges near the pointed end are made e.g. by stamping. Next, each of the pen nib pieces 1 is bent either in ship-bottom shape along the bending line 2 or round e.g. by pressing. Then the pen nib pieces 1 are fixed back-to-back to each other, e.g. by cementing or spot welding. As illustrated above, because the pen nib pieces are bent in ship-bottom shape, the pen nib 5 is provided with an ink channel 7 in the center thereof as shown in FIG. 3. The central top end of the pen nib 5 composes a drill-like pointed end of the pen by gathering the pointed end of each of the pen nib pieces as shown in FIG. 4. FIG. 4 is more enlarged than FIG. 3.

The pen nib 5 has three concavities 6 and three projections 12 disposed alternately along its outside. As shown in FIG. 1*a*, each of the pen nib pieces 1 is provided with a split 3 at its pointed end and also with notches 4 at its both edges. Therefore, the pen nib 5 is provided at its pointed end with three splits 3 and three recesses 8 formed by the notches 4 which are disposed alternately at equal angular distance as shown in FIG. 4 when it is constructed by a plurality of pen nib pieces. And, inside said ink channel 7, which extends from the root of the pen nib 5 to near the pointed end, an ink feed needle 10 consisting of some wire strands twisted together of a relatively small diameter is fixed for feeding ink from the root of pen nib 5 to the pointed end.

The pen nib 5 is fitted in a holder e.g. of a synthetic, separately made, e.g. by molding. The holder is provided with some ink feed grooves which feed the ink from the ink reservoir (or the barrel), or a cartridge to the root end of the pen nib 5, and the ink led therein through them enters into the ink channel 7 at the root end of the pen nib 5 and then flows to the pointed end of the pen nib 5.

However, the conventional multiangular pen nib construction in prior art has been found to have the following disadvantages. The pen nib pieces 1 are bent so that the ink channel 7 may have a relatively large cross-sectional area, therefore the ink feed needle 10 which usually is made thick of a plurality of wire strands twisted around each other is inserted therein to feed ink effectively through the ink channel 7. Accordingly, it is very difficult to insert such a needle into the ink channel 7 if the needle loses its tightness. And also twisted wires of the strand are easy to stick to the root edges and side walls of the ink channel 7. Consequently, there has been a problem with the manufacturing cost caused to rise because of its complex process.

In addition, the supply of the ink to the pointed end of the pen nib 5 is performed only through the ink channel 7 provided in the center thereof, and ink feed needle 10 disposed in the ink channel 7. The portion of the ink channel 7 where the ink feed needle 10 is inserted is relatively narrow compared with the ink containing portion 11 provided near the pointed end of the pen nib 5 so that while the pen is being used, the ink channel in the pen nib construction is liable to be clogged with paper fibers or dust which have been brought in and stick in or above the ink containing portion 11. Furthermore, considering the technique of a conventional multangular pen nib construction from the point of view of function or action, it is based on a technical idea to make ink flow down from the reservoir along the inside of the pen nib. In order to make ink flow more efficiently the ink feed needle 10 is used, and the ink feed needle is made of the twisted wire strands. Therefore, ink comes to be supplied relatively smoothly to the pointed end of the pen nib through the ink channel when the user writes with a pen including such a pen nib. But, on the other hand, if a pen with a cap is kept standing (a pen nib points upwards), ink which has flowed down to the pointed end of the pen flows reversely in the ink channel 7, and returns into the ink reservoir of the pen. And then, the pen nib becomes dry. Consequently, it has been a fatal disadvantage that ink does not flow out onto the paper at once when the user is about to write next time.

SUMMARY OF THE INVENTION

It is therefore an object of the present invention to provide such a multangular pen nib construction that is easy to manufacture and almost free from clogging at the pointed end of the pen nib, and further does not flow reversely even if the pen remains standing with the pen nib pointing upwards.

It is another object of the present invention to provide such a multangular pen nib construction that the ink supplied to the root of the pen nib held by the holder can be led smoothly through the ink channel or the outside of the pen nib to the ink containing portion.

The present invention differs particularly from the conventional multangular pen nib construction in the following points that the pen nib form a capillary vessel by having as its center, an ink channel being of capillary size and that the pen nib is capable to feed ink from the ink reservoir or main ink chamber of the pen to the pointed end of the pen nib without using a ink feed needle. The multangular pen nib construction of the present invention has fewer parts than the conventional ones and can decrease the processes of pen manufacturing to a large extent. And also, even when the pen is not used and is standing with its pen nib pointing upwards, ink is fed to the pointed end of the pen nib continuously by capillarity action and said pointed end is kept in wet condition.

The pen nib construction according to the present invention comprises a plurality of pen nib pieces that are bent to have sharp corners and a V-shaped section and are fixed back-to-back to each other. So this pen nib has projecting elements and concave elements disposed outward alternately and at an equal angular distance. At least one of these pen nib pieces has an inflow slit at the intermediate portion thereof extending along the longitudinal axis, and through the inflow slit the ink channel in the center of the pen nib can open to the outside. The pen nib is fitted in a holder and these members form a multangular pen nib construction. One end of the holder is divided into a plurality of ink feed tongues, and the holder is provided with a groove extending through the body thereof from its root end connected to the inner surface of the root of the ink feed tongues. So, when the ink feed tongues elastically contact the outer surface of the pen nib, the pen nib is held in the holder as well as ink is fed from the ink reservoir to the root of the pen nib through the groove. Some ink that is fed to the root of the pen nib rises or advances through the ink channel towards the pointed end of the pen nib by capillarity action. On the other hand capillarity action also takes place at the position outside the pen nib where ink feed tongues contact the outer surface of the pen nib. The remainder of ink reaching the root of the pen nib also rises or advances along the outer surface of the pen nib towards the pointed end thereof and enters into the ink channel and ink containing portion through the inflow slit formed on the pen nib piece. As described above, ink is supplied through a plurality of passages to the pointed end of the pen nib and therefore the pen nib is free from unsufficient supply of ink due to a very narrow ink channel. The present invention will be further described with reference to the embodiments illustrated in the accompanying drawings.

DETAILED DESCRIPTION OF THE PREFERRED EMBODIMENTS

Now, an exemplary embodiment of the present invention will be described.

Figure 1:
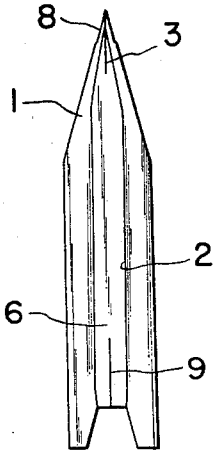
PRIOR ART FIG. 1
FIG. 1 is a front view of a pen nib piece used in a conventional multangular pen nib construction of the prior art.
Figure 1A:
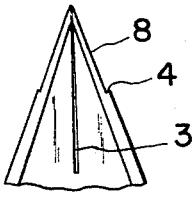
PRIOR ART FIG. 1a
FIG. 1*a* is an enlarged view illustrating a portion of the same.
Figure 2:
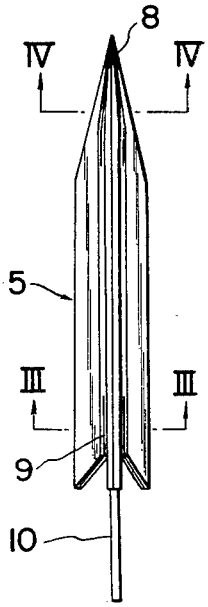
PRIOR ART FIG. 2
FIG. 2 is a front view of a pen nib comprising the pen nib pieces shown in FIG. 1.
Figure 3:
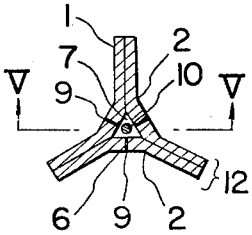
FIG. 3 PRIOR ART
FIG. 3 is an enlarged sectional view taken on line III—III of FIG. 2.
Figure 5:
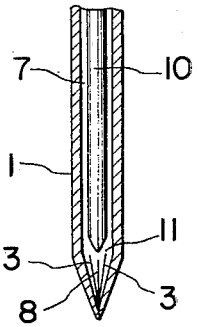
PRIOR ART FIG. 5
FIG. 5 is a sectional view taken on line V—V of FIG. 3.

Referring to FIG. 6 to FIG. 9, a pen nib construction according to an embodiment of the invention is illustrated. In this embodiment, pen nib 15 is made of a thin metal plate having constant strength and comprises a plurality of pen nib pieces 13 fixed back-to-back to each other, and each of the pen nib pieces 13 has a slit or split 16 at the center of the pointed end and another slit or split 14 at its root. And, the pen nib piece is provided with notches 4 similar to that shown in FIG. 1*a*, at both edges thereof, and is V-shaped by being bent along the longitudinal axis. As is obvious from FIGS. 7 and 8, the pen nib 15 comprises three pen nib pieces 13. The pen nib pieces 13 are bent at an angle of 120° substantially. In the bending process of the pen nib piece 13, said pen nib piece 13 is bent to have a sharp corner along the longitudinal axis and a V-shaped cross section. On the other hand, the pen nib piece 13 is provided with an inflow slit 17 with a narrow width which does not continue with the splits 14 and 16 on or adjacent its axial line and retains original plate portion between them to keep the constant strength of said metal plate.

Figure 4:
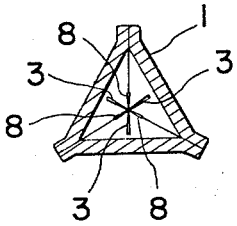
FIG. 4 PRIOR ART
FIG. 4 is an enlarged sectional view taken on line IV—IV of FIG. 2.
Figure 6:
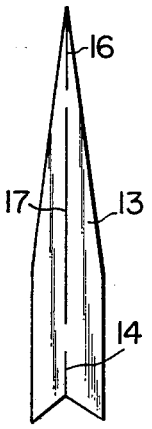
FIG. 6 is a front view of a pen nib piece used in a multangular pen nib construction of the present invention.
Figure 7:
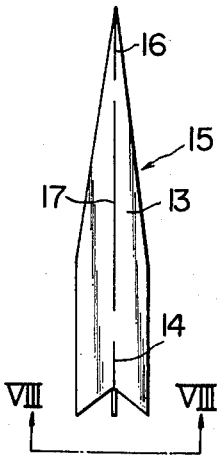
FIG. 7 is a front view of a pen nib used in a multangular pen nib construction of the present invention.
Figure 8:
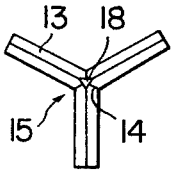
FIG. 8 is an enlarged plan view taken in the direction designated by the arrow shown in FIG. 7.
Figure 9:
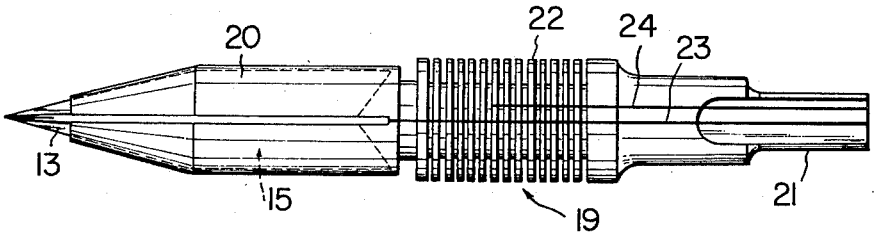
FIG. 9 is a front view of the multangular pen nib construction of the present invention.

Because the pen nib piece 13 is formed as above, the pen nib 15 comprising a plurality of the pen nib pieces 13 has inflow slits 16, 17, and 14 disposed on the vertical line respectively as shown in FIG. 7. And also, in the end view from the pen nib root, it is found that the pen nib 15 is provided with a narrow ink channel 18 surrounded with the pen nib pieces 13. The diameter of the ink channel 18 is so small that ink can rise in it by capillarity action. The ink channel 18 extends centrally from the root to the pointed end of the pen nib 15, and continues with the split 16 and recess (similar to that designated by numeral 8 in FIG. 4) formed by the adjacent notches 4 of the fixed pen nib pieces 13. Generally, the split 16 is about 8 milimeters long and the notch 4 is about 2 to 3 milimeters long, so the pen nib 15 has, similarly to the conventional embodiment shown in FIG. 4, three long splits 16 and three relatively short recesses formed by notches 4, which are disposed alternately and at substantially equal angular distances and ink flows out through them onto the paper when the pen is being used. The length of the slit 16 and the notches 4 should not be limited in the forementioned length, but may be set at other proper lengths. The pen nib 15 having such a structure is fitted in a holder 19 made of for example, synthetic resin, separately made by for example, molding so as to compose a multangular pen nib construction.

The holder 19 includes ink feed tongues 20 divided into three portions at its tip end, and a root end 21 which leads ink from the ink reservoir of the pen or of the cartridge when the the holder 19 is mounted on the pen body, and also ink feed groove 23 extending from the root end 21 to the middle of the holder 19 (or root of the tongues 20). In addition, the holder 19 has a plurality of flanges 22 axially disposed at determined distances on the outer side of its body, and from the flanges 22 to the root end 21, a vent channel 24 is slotted. The ink feed tongues 20 have such an inner surface that is formed to be able to allow the pen nib pieces 13 to fit elastically in each bent concavity of the tongues 20 to keep a tight contact with that concave surface and with the outer surfaces of the pen nib pieces 13. Therefore, when said pen nib 15 is inserted into the gap between said ink feed tongues 20 of the holder 19, the ink feed tongues 20 contact elastically to each of the outer peripheral surfaces of the pen nib 15 and hold this pen nib 15 tightly.

The ink feed groove 23 extends from the root end 21 of the holder 19 to the inner surface of the root of said ink feed tongues 20. Ink flows from the ink reservoir of the pen to the root of said ink feed tongues 20 through the ink feed groove 23 and reaches the root of the pen nib 15. Some ink led to the root of the pen nib 15 further advances through the ink channel 18 towards the pointed end of the pen nib 15 by capillarity action taking place in the ink channel 18. This capillarity action is taking place in the portion between pen nib 15 and an ink feed tongue 20 contacting each other and therefore, the reminder of ink led to the root of said pen nib 15 further advances along the outer surface of the pen nib 15 toward the pointed end of said pen nib 15 and enters into the ink channel 18 through the inflow slit 17 formed on the pen nib piece 13.

As described above, ink is supplied through a plurality of passages such as ink channel 18 and outer surface of the pen nib 15 to the pointed end of said pen nib 15, so sufficient ink will be supplied continuously when the pen is being used and will be free from clogging. The inflow slit 17 has a very narrow width, so capillarity action also takes place therein. Thus, because ink is supplied to the pointed end of the pen nib 15 through several kinds of passages by capillarity action as mentioned above, even when the pen nib 15 is not being used and is left with its pointed end pointing upward, ink does not flow reversely. Also, because the pen nib 15 is kept in wet condition at all times, a user can begin to write without the pen clogging or scratching. Furthermore, because nothing is inserted in the ink channel 18 of the pen nib 15 and the inside of the ink channel is formed hollow, the disadvantages, that said ink channel 18 of the pen nib 15 is liable to be clogged with fine pieces of dust and so on straying into the ink channel 18 through the recesses of the pen nib, have been decreased to a large extent. And also, because the pen nib has a plurality of passages to feed ink, the pen nib is almost free from clogging and always writes very well.

As described above, according to the present invention, I provide a multangular pen nib construction which is easy to manufacture, which is free from clogging, and which can be left with its pointed end to point in any direction without reverse flowing of ink, resulting in obtaining an inexpensive and high-quality fountain pen.

I claim:

1. A multangular pen nib construction connected to a main ink chamber comprising a plurality of substantially V-shaped pen nib pieces attached back to back along the convex portions of the V-shape to form projecting arms and a common center of the bases of the V-shaped pen nib pieces, a pointed end on one end of each of said pen nib pieces forming a writing point on the end of the pen nib construction, a channel having walls producing capillary action between said walls formed between said pen nib pieces at said common center of said V-shaped pen nib pieces running longitudinally along said channel walls of said pen nib pieces, each of said pen nib pieces having notches near said pointed ends forming a recess along a projecting arm of the V-shape from the point on said pointed end to said notch, at least one of said pen nib pieces having at least one inflow slit through the base of the V-shape extending longitudinally along the base of said pen nib piece for a predetermined length within the central portion between said pointed end and the end opposite the pointed end, spaced from said ends and connecting said capillary sized channel to the outside surface of the pen nib construction, a pen nib holder having feeder tongues contacting outer projecting arms of the V-shape of said pen nib pieces, said pen nib holder connected to the main ink chamber whereby ink emanating from the main ink chamber passes through said capillary sized channel and also flows by said feeder tongues through said inflow slit into said channel to said pointed ends of said pen nib pieces.

2. The multangular pen nib construction according to claim 1 further characterized by at least one of said pen nib pieces having additional inflow slits extending longitudinally through the base of the V-shape of said pen nib piece for predetermined lengths.

3. The multangular pen nib construction according to claim 2 further characterized by extending arms of the V-shape of said pen nib pieces disposed at angular distances of about 120° from each other.

4. The multangular pen nib construction according to claim 1 further characterized by extending arms of the V-shape of said pen nib pieces disclosed at angular distances of about 120° from each other.

* * * * *